US007000447B1

(12) United States Patent
Burkhart

(10) Patent No.: US 7,000,447 B1
(45) Date of Patent: Feb. 21, 2006

(54) TUBE BENDING MACHINE

(76) Inventor: Vernon D. Burkhart, 218 W. Rutledge, Yates Center, KS (US) 66783

( * ) Notice: Subject to any disclaimer, the term of this patent is extended or adjusted under 35 U.S.C. 154(b) by 65 days.

(21) Appl. No.: 11/034,612

(22) Filed: Jan. 13, 2005

(51) Int. Cl.
*B21D 31/00* (2006.01)

(52) U.S. Cl. ..... 72/390.6; 72/389.1; 72/389.3

(58) Field of Classification Search ..... 72/389.1, 72/389.3, 389.4, 389.9, 390.2, 390.3, 390.4, 72/390.5, 390.6, 390.7
See application file for complete search history.

(56) References Cited

U.S. PATENT DOCUMENTS

| | | | | | |
|---|---|---|---|---|---|
| 983,664 | A | | 2/1911 | Wilson | |
| 3,855,838 | A | * | 12/1974 | Jackson | 72/389.4 |
| 4,483,175 | A | * | 11/1984 | Hansen | 72/389.5 |
| 4,569,219 | A | * | 2/1986 | Threlkel et al. | 72/390.6 |
| 5,027,633 | A | * | 7/1991 | Smith | 72/390.06 |
| 5,237,847 | A | * | 8/1993 | Owens | 72/389.3 |
| 5,528,921 | A | * | 6/1996 | Herman | 72/389.1 |
| 5,615,572 | A | * | 4/1997 | Johnson et al. | 72/389.1 |
| 5,761,950 | A | * | 6/1998 | Chiu | 72/390.5 |

FOREIGN PATENT DOCUMENTS

| | | |
|---|---|---|
| DE | 485636 | 11/1929 |
| FR | 1188685 | 9/1959 |
| GB | 1444385 | 7/1976 |

* cited by examiner

*Primary Examiner*—David B. Jones

(57) ABSTRACT

A machine for bending thin wall electrical conduit having first and second spaced apart forming shoes, each having partial arcuate forming surfaces and a movable arcuate shaped third forming shoe mounted on the tabletop between the first and second forming shoes connected to an actuator for lineal movement forcing a section of tubing against the first and second forming surfaces with quick release retention wheels mounted on a flat plate in a cavity in the tabletop, the cavity having a load-supporting vertical edge for supporting the retention members under load and a pocket on the opposite side from the load supporting edge receiving an edge of the plate preventing it from lifting out of the cavity under load.

3 Claims, 4 Drawing Sheets

FIG 5
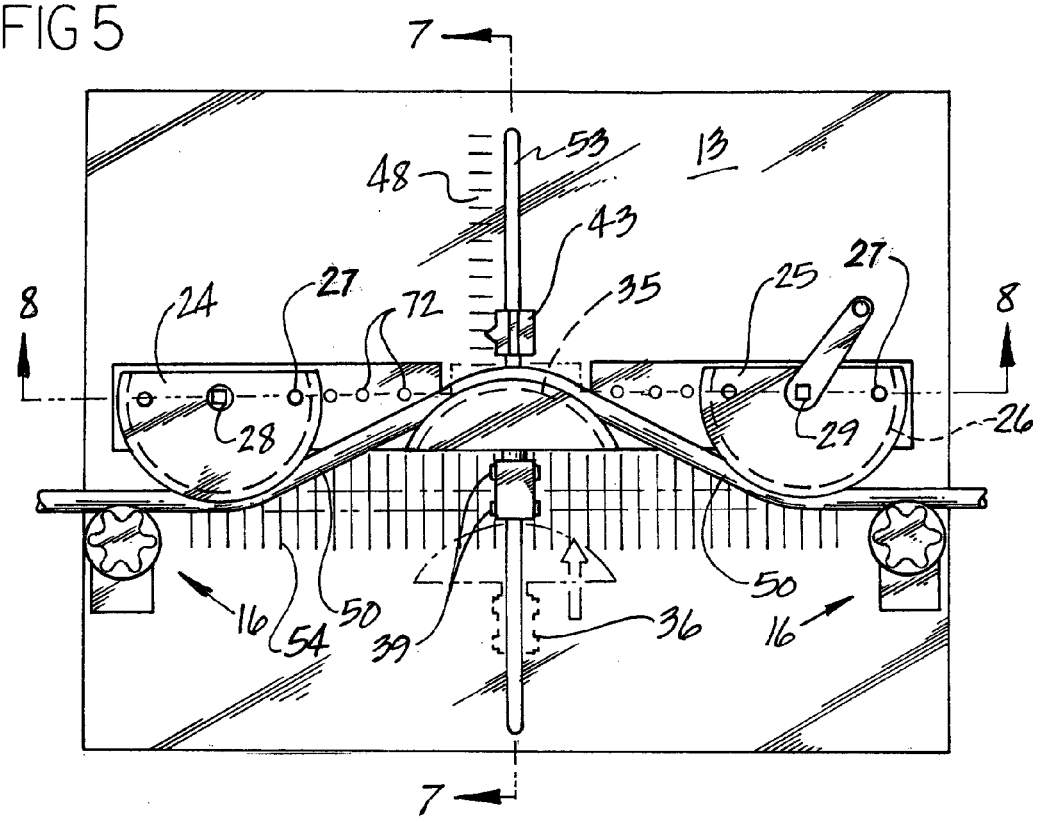
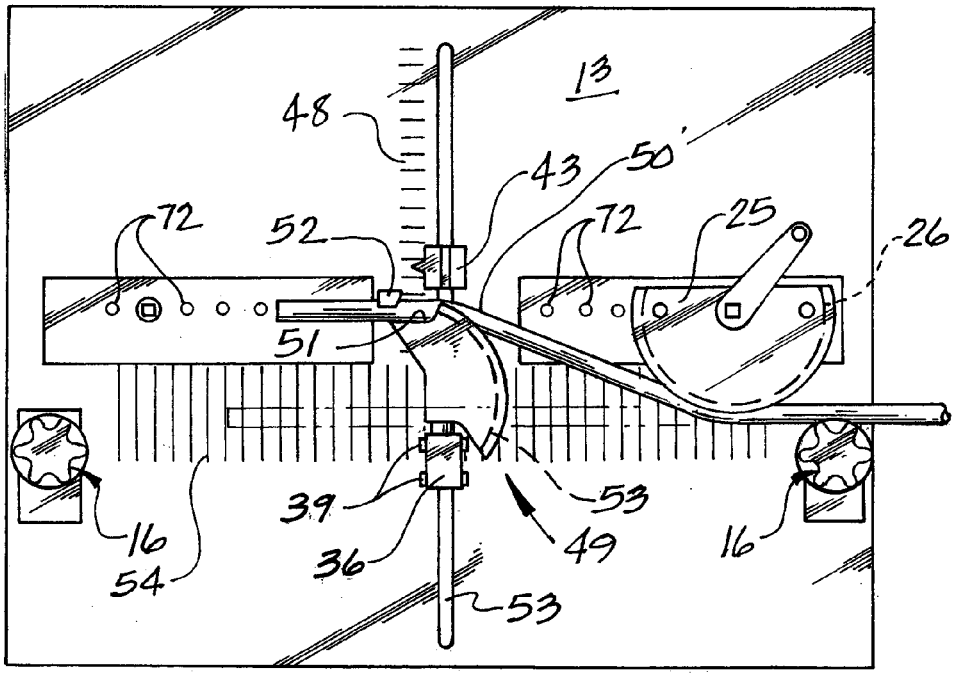
FIG 6

TUBE BENDING MACHINE

The present invention relates to tube bending and more particularly with apparatus which produces accurately bent electrical conduit tubing in a single operation which reproducible at an increased rate of speed.

BACKGROUND OF THE INVENTION

Tube bending machines have been designed and used for at least the past one hundred years, as indicated in the prior art. Many of those machines required a single set up for each bend, while more modern machines such as the present invention, performed multiple bends in a single set up. Many of these machines have been relatively large and unwieldy, and not particularly adaptable to on-site construction. Electrical conduit bending in commercial buildings today frequently utilize a set of standard bends, which would include right angle bends, flat saddle bends, round saddle bends and off-set bends. With these uniform bending designs, all of the tubing for a commercial structure can be pre-bent to set dimensions rather than the old method of bending each section of tubing on the site as it is installed, which is far more time consuming.

The machine of the present invention will produce all of the above mentioned bends to set dimensions in a matter of seconds for each tube, and then accurately duplicate those bends however many times needed with each one being precisely like the one before.

SUMMARY OF THE INVENTION

The present invention has an enhanced level of productivity and accuracy over other machines in the marketplace. Once the machine is set up, the bending operation can be accomplished by an electrician's helper or apprentice, thus, minimizing the labor rate for producing a pre-formed tubing.

The set up time to change bends or diameter of tubing, with the present invention, is minimized with its various quick release components. To hold the ends of tubing during bending, a quick release retention wheel is retained in a cavity in the top of the bending table, which quickly releases as it is lifted upward. The retention wheel while in use is capable of substantial horizontal loadings without releasing. The forming shoes, on which the tubing is bent, are freely mounted on an open-ended axle. The axle includes a square-shaped end, which can quickly be engaged by a hand crank for removing the axle so as to change the setting as to the width of a saddle bend. The movable forming shoe, which bends the tubing against other forming shoes, is driven by a screw actuator which causes a slide member to move linearly in a slot in the table until it reaches the preset position of the pointer flag whereupon a micro-switch or an electronic sensor stops the motor at a precise position pre-determined by a pointer flag which is set opposite a scale thus defining the offset distance of the particular tubing being bent.

It is, therefore, the object of the present invention is to provide an electrical conduit-bending machine with increased production capability and repeatable accuracy.

Another object of the present invention is to provide a bending machine for various diameter conduit which has quick release bending shoes and stops.

Another object of the present invention is to provide a portable conduit bending machine electrically powered by a hand-held remote control.

DESCRIPTION OF THE DRAWINGS

FIG. 5 is a top plan view of the tube bending machine with the forming shoes and retention wheels positioned to form a round saddle bend;

FIG. 6 is a similar view to FIG. 5 with the forming shoes positioned to form an offset bend;

DESCRIPTION OF THE PREFERRED EMBODIMENT

Figure 1:
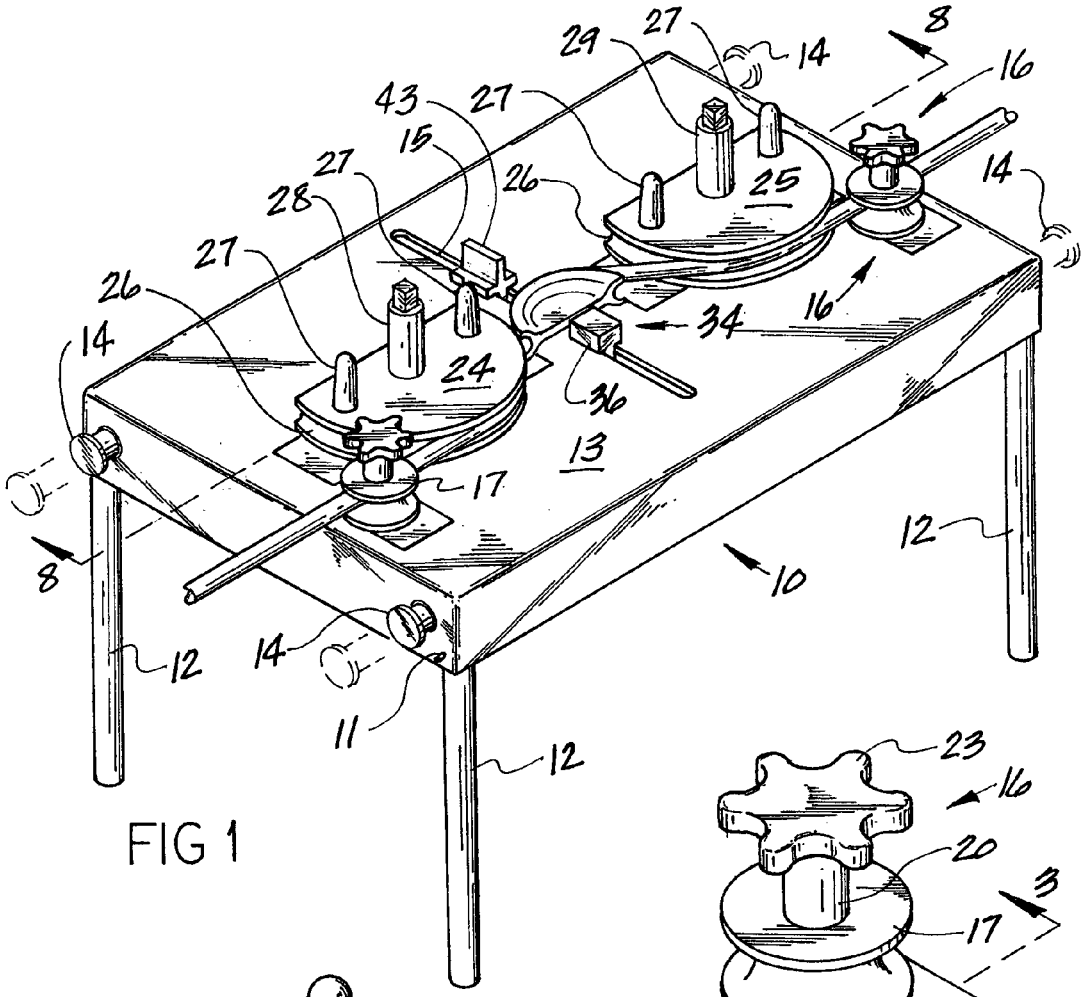
FIG. 1 is an isometric view of a tube bending machine constructed with the principals of the present invention, set up to form a round saddle bend.
Figure 7:
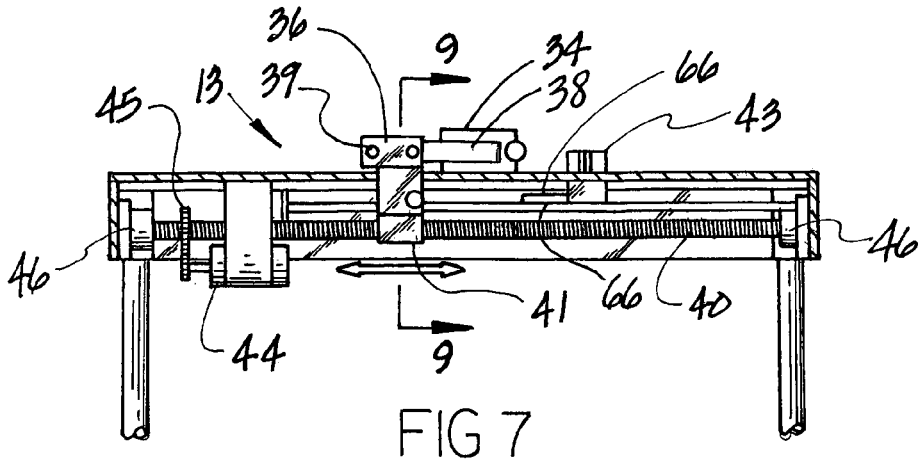
FIG. 7 is a sectional view taken along line 7—7 of FIG. 5.
Figure 9:
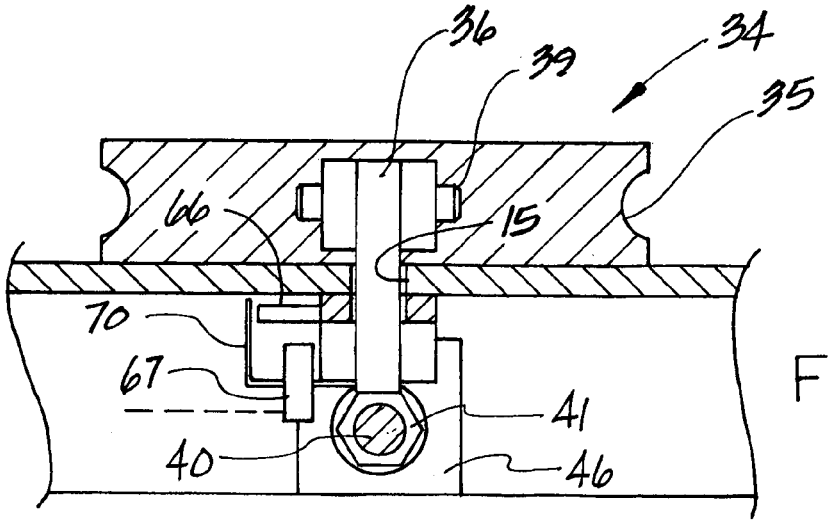
FIG. 9 is a detailed view of the powered forming shoe to an enlarged scale showing the drive screw actuator and its associated parts taken along line 9—9 of FIG. 7.
Figure 10:
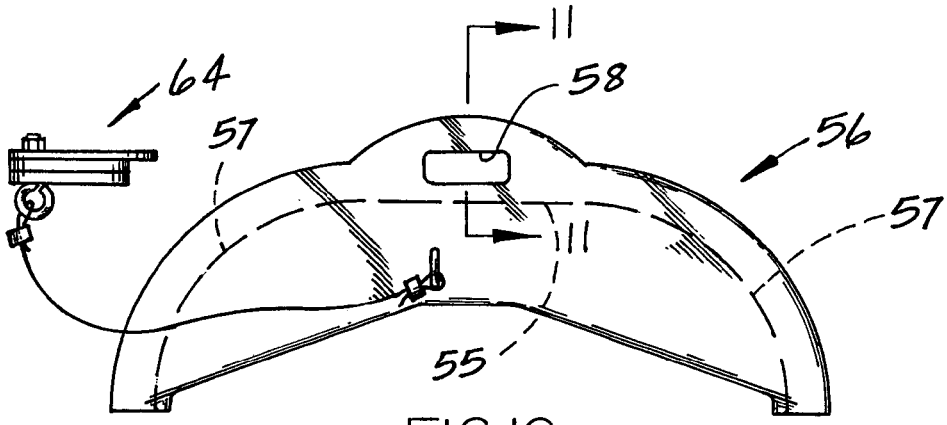
FIG. 10 is a plan view of a flat saddle shoe with its connected shim stop assembly shown removed.
Figure 11:
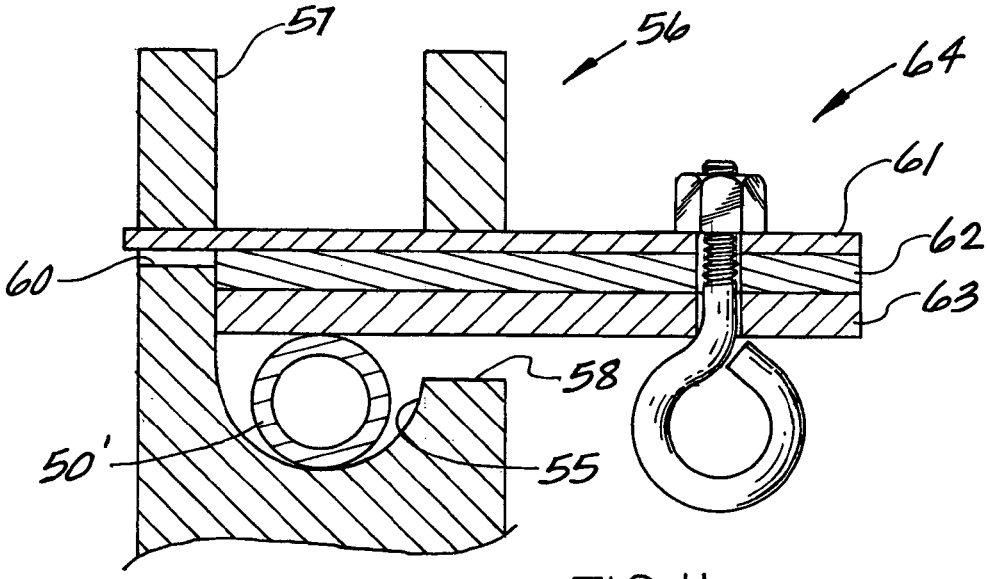
FIG. 11 is a sectional view to an enlarged scale taken along line 11—11 of FIG. 10 with all the shims inserted for a minimum diameter conduit.

Referring in detail to the drawings, the bending machine of the present invention is generally referred to by reference numeral 10 as shown in FIG. 1. The machine 10 comprises a table top 13 supported by a four moveable legs 12 which are held in place by set screws 11. Located at the four corners of the table are retractable handles 14. The machine 10 is easily transported by two persons with the legs either removed or in place. Located in the center of the table 13 is a bearing slot 15 in which is positioned a slide member 36 which in turn drives a powered forming shoe 34 back and forth in slot 15. Positioned under slot 15 and parallel thereto is a screw actuator 40, also referred to as a jack screw, which is rotatably journaled at both ends of the table, as seen in FIG. 7, and is powered by a reversible motor 44 through gears 45. Actuator screw 40 is rotatably supported in journals 46 located at each end of the screw, which in turn are mounted on the sidewalls of top 13. Slide 36 is connected to a threaded bushing 41, which moves the slide 36 forwards and backwards depending upon the rotational direction of screw 40. Slide 36 includes a pin 38, as seen in FIG. 7, which supports round saddle forming shoe 34, and is essentially half circular in shape. While FIGS. 1, 5, 7, and 9 illustrate a round saddle forming shoe, other types of forming shoes can be utilized such as a flat saddle shoe 56, as shown in FIGS. 10 and 11, and a offset forming shoe 49, as shown in FIG. 6.

While the previously mentioned forming shoe 34 moves in a linear direction in slot 15 there are also two stationary forming shoes 24 and 25 which are half circular in shape and rotate about fixed axles 28 and 29 as shown in FIG. 1. Located on the arcuate surface of forming shoes 24 and 25 is a recessed trough 26 which receives essentially half of the tube or conduit 50 being bent. Forming shoe 34 includes a similar trough 35. When bending a different diameter conduit such as ½ inch, ¾ inch and 1 inch, a different set of shoes 24, 25 and 34 are utilized wherein the trough 26 fits the diameter of the tubing being bent. The shoes for each diameter are typically all painted the same color so that they can be readily identified.

While bending tube 50, as shown in FIGS. 5 and 1, the outer ends of the tubing 50 must be supported by retention wheels 16, also referred to as quick brakes. Once the tubing is formed, as shown, the quick brake 16 are lifted upward by handles 37 so that the formed tube 50 can be removed from the machine.

Figure 2:
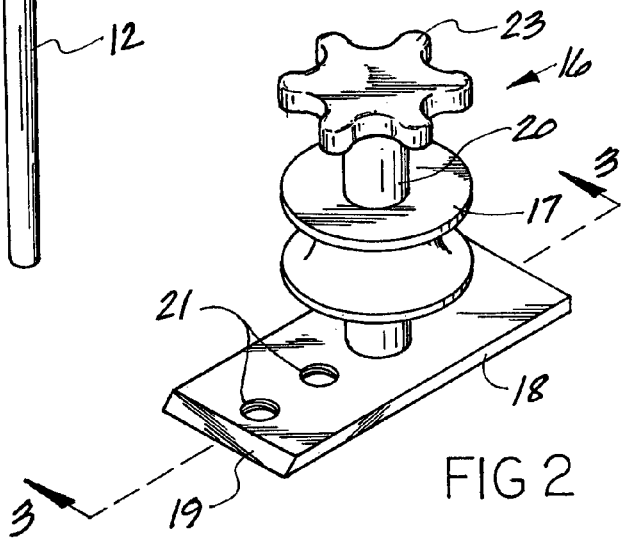
FIG. 2 is an isometric view to an enlarged scale of the quick release retention wheel also referred to as the quick brake.
Figure 3:
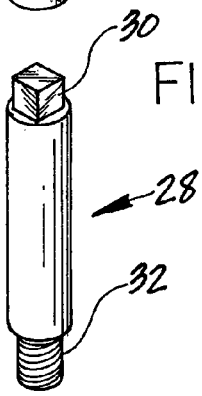
FIG. 3 is a sectional view taken along lines 3—3 of FIG. 2 with the supporting plate of the retention wheel positioned in a cavity in the bending machine table.
Figure 3:
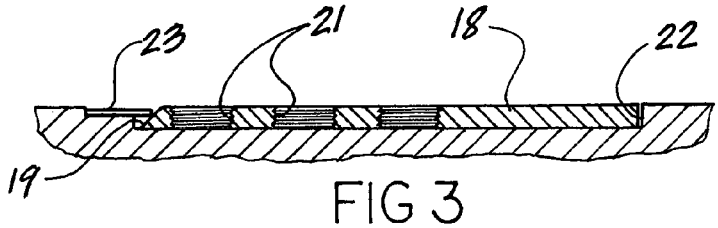

Quick brake 16, as shown in detail in FIGS. 2 and 3, comprises a wheel 17 having a trough therein which freely rotates on axle 20. The lower end of axle 20, as shown in FIGS. 2 and 3, is threaded into holes 21 in a flat rectangular plate 18. Plate 18 is positioned in cavity 22 in the top of table 13, as shown in FIG. 3 and FIG. 1. The forward edge of plate 18 has a beveled edge 19 which is received in a pocket formed by an overlapping plate 23 attached to top 13 while the rear edge of plate 18 butts against the vertical edge of cavity 22. During bending the load on quick brake 16 is to the right, as seen in FIG. 3, with overlapping plate 23 preventing the quick brake from tilting out of cavity 22. To remove quick brake 16, the handle of 37 is gripped, lifting the rear edge of plate 18 upward and thereby removing the quick brake 16 from the table.

Figure 4:
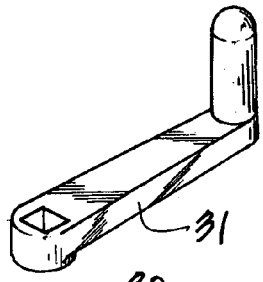
FIG. 4 is an isometric view to an enlarged scale of a quick release axle and an associated hand crank.

Quick release axle 28, as shown in FIG. 4, is threadably received in any one of a series longitudinal holes 72 spaced in parallel relationship with the length of the tubing 50 being formed, as shown in FIGS. 5 and 6. The spacing of these holes 72 permits forming of saddles having different widths. Quick release axles of 28 and 29 include a square head 30 at the upper end, which is engagable by a removable crank 31 thereby permitting a quick repositioning of the longitudinal spacing of axles 28 for various width saddle bends. The three laterally positioned holes 21 in plate 18 permit various size tubing to be inserted between forming shoe 24 and wheel 17 of quick brake 16.

An offset bend conduit 50', as illustrated in FIG. 6, utilizes a different forming shoe 49, with forming shoe 25 and right quick brake 16. Offset forming shoe 49 includes a slot 51 through which the conduit 50' is inserted. Located on the left side of slot 51 is a retention projection 52, which takes the place of left quick brake 16. As the forming shoe 49 begins to move upward, the left end of the tube 50' is held horizontal while the center section of the tube is bent about the arcuate surfaces of shoe 49 and stationary shoe 25.

Figure 8:
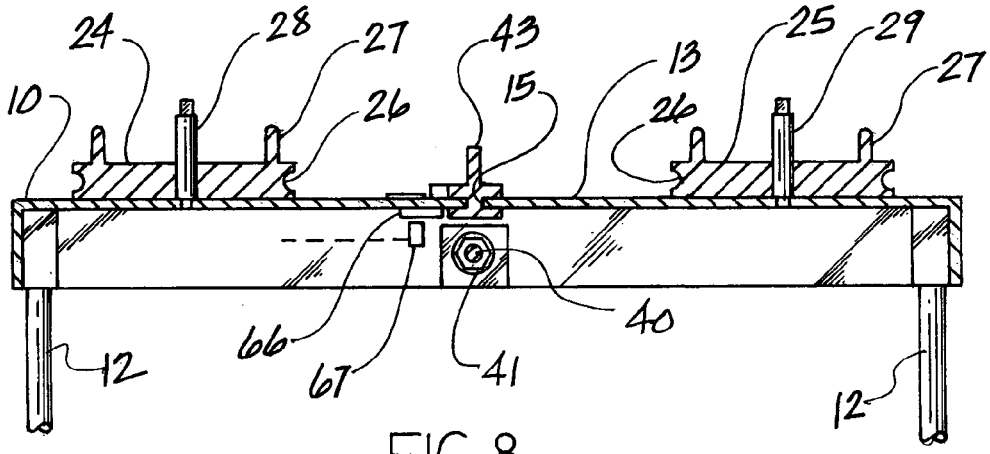
FIG. 8 is a sectional view taken along line 8—8 of FIG. 5.
Figure 12:
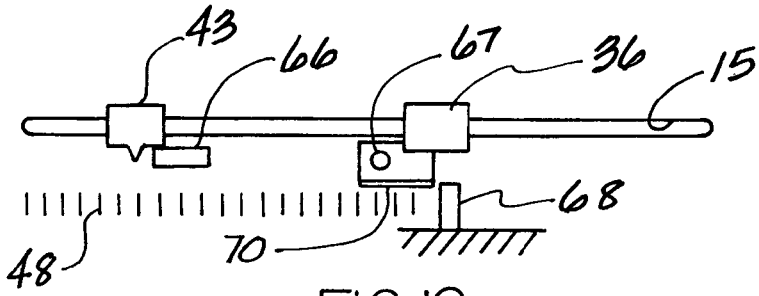
FIG. 12 is a schematic plan view of the automatic preset bending apparatus and its sensors.

Positioned laterally on table top 13, as seen in FIGS. 5 and 6, is a scale 48 which determines the lateral offset dimension of the particular tube being bent. Positioned in slot 15 is a pointer flag 43, as seen in FIGS. 1, 5, 6, 7 and 8. A pointer flag 43 includes a pointer, which is aligned with the scale 48 to define the inches of offset the bending machine is to form. Attached to the underside of pointer flag 43, as seen in FIGS. 8 and 12, is a flat metal plate 66. A first sensor means 67 is mounted on slide 36 underneath the table and moves with bending shoe 34, as shown in FIGS. 7, 9 and 12. When the sensor means 67 passes under the edge of flat plate 66; the sensor 67 opens a relay and screw actuator motor 44 is stopped at the precise offset distance required for the bend. The sensors 67 and 68 are inductive proximity sensors well known in the prior art such as Cutler Hammer Model 182A505-A. The operator controlling the machine moves a hand held switch, not shown, to the retract position, wherein screw motor 44 is activated in the reverse direction and slide 36 and forming shoe 34 are returned to the initial position, whereupon a vertical metal plate 70 moving with the slide member 36 passes a second stationary sensor 68 and stops the rotation of the screw actuator 40 as shown in FIG. 12. Second sensor 68 is stationary and mounted on the underside of tabletop 13.

The bending shoes 24, 25 and 34 all require a trough 26 and 35 in the shoe that corresponds with the diameter of the conduit being bent. The supports for all the above-mentioned shoes are all sliding fits permitting a quick removable and substitution for shoes having different width troughs. For example, both shoes 24 and 25 are merely lifted off their support axles 28 and 29, while forming shoe 34 is slid horizontally off of pin 38. If the width of the offset bend needs to be widened, axles 28 and 29 are quickly removed by hand crank 31 and reset in a series of longitudinally spaced threaded holes 72, as seen in FIGS. 5 and 6. Shoes 24 or 25 when rotated 180 degrees, releases the conduit section 50 for removal. The offset bend conduit shown in FIG. 6 is removed from the machine by rotating forming shoe 25, 180 degrees and then sliding conduit 50' to the right until the left end of the conduit clears offset forming shoe 49.

The retention wheel 17 of quick brake 16 does not require a precise diameter trough in their contact since the tubing 50 is not being bent about those arcuate surfaces of wheel 17, but rather merely held in place while the bending of the tubing is taking place on the larger diameter forming shoes 24, 25, 34 and 49. To accommodate different tubing diameters, the quick brakes 16 must be slightly adjusted laterally from forming shoes 24 and 25. This lateral adjustment takes place by resetting axles 20 in quick brake 16 in one of three holes as illustrated in FIGS. 2 and 3. In the prior art, this is achieved by a second and third row of holes 72 laterally spaced in the table top 13. The wheels 17 and the quick brakes 16 are easily reset in different holes 21 in the mounting plate 18 as seen in FIG. 2 and by handle 23. All of the adjustments on the bending machine of the present invention are achieved manually without any additional tools, thus decreasing the change time between different bends, different diameter tubing, and different width saddles.

A flat saddle bend is achieved by replacing round saddle-bending shoe 34 of FIG. 1 with forming shoe 56 as shown in FIG. 10. A flat saddle bend includes two arcuate sections 57 joined by a straight section 55, as seen in FIG. 10. To achieve this bend, it is necessary to retain the conduit in bending shoe 56 at the center of the shoe so it retains a straight section in the bend rather than one large circular section. This is achieved with the use of shim assembly 64, as shown in FIGS. 10 and 11. Shim assembly 64, as best seen in FIG. 11, includes three varying thickness shim plates 61, 62 and 63 which are adjusted for the diameter of tubing being bent so that the tubing 50' is held within trough 57. Shim assembly 64 is inserted in shoe 56 through slot 58 on the right side as seen in FIG. 11 with the thinnest shim 61 extending across 57 to the opposite side through a slot 60. The shape of the shims and thickness, of course, could be varied to handle additional diameter tubing as required. The shim assembly 64 is held together by an eyebolt and cable 65 so that it is not separated from forming shoe 56 when not in use.

The electrical control of the machine, which is not shown, can be any type of forward and reverse switch that can be mounted in the body of the table top 13 or on an electrical cable which the operator can hand hold while moving around the table.

In the typical operation, the operator will set the pointer flag 43 in alignment with scale 48 at the precise offset of the bend that is desired. Pointer flag 43 has an attached metal plate 66 positioned under the table as seen in FIGS. 8, 9 and 12. Attached to slide 36 and forming shoe 34 is a sensor 67, which moves with the forming shoe 34 and when sensor 67 passes the front edge of plate 66, a relay stops motor 44 at that precise offset position. When the controller switches to the return position, motor 44 is energized in the opposite direction and retracts the forming shoe assembly to its retracted position which is determined by the stationary second sensor 68 located under the table and energized by a vertical plate 70 passing thereby.

Although this invention has been disclosed in the context of certain preferred embodiments in examples, it will be understood by those skilled in the art that the present invention extends beyond the specifically embodiments to other alternative embodiments and obvious modifications and equivalents. According to the way it is intended that the scope of the present invention herein disclosed should not be limited by the particular disclosed embodiments described upon, but should be determined only by a fair reading of the claims that follow.

What is claimed is:

1. A machine for bending thin wall tubing having a table top;

first and second spaced apart forming shoes each having partial arcuate forming surfaces mounted on the table top;

a linear arcuate forming shoe mounted on the table top between the first and second forming shoes connected to the actuator for linear movement forcing a section of tubing against the first and second forming surfaces, the improvement comprising:

a quick release retention member mounted on a flat plate;

a cavity in the table top for receipt of said flat plate, the cavity having a load supporting vertical edge for supporting the retention member when under load;

a pocket in the cavity on the opposite side from the load supporting edge receiving an edge of the plate and preventing it from lifting out of the cavity under load.

2. A machine for bending tubing as set forth in claim 1 wherein the quick release retention member includes a wheel mounted on a shaft, the shaft having a handle at one end and the other end being threaded, and the flat plate having at least two threaded holes, the holes being aligned to position the retention member at varying positions from the first and second forming shoes to accommodate different diameter tubing.

3. A machine for bending tubing as set forth in claim 1 including a quick release axle threaded at one end for engaging a threaded hole in the table top for rotatably supporting the first and second forming shoe, the opposite end of the axle having a non-circulate shape and a removable hand crank having a like non-circular shape to engage and remove said axle.

* * * * *